US005809961A

United States Patent [19]

Morota et al.

[11] Patent Number: 5,809,961

[45] Date of Patent: Sep. 22, 1998

[54] INTAKE PASSAGE STRUCTURE FOR AN INTERNAL COMBUSTION ENGINE

[75] Inventors: Kenjiro Morota; Kanji Sakaguchi, both of Toyota, Japan

[73] Assignee: Toyota Jidosha Kabushiki Kaisha, Toyota, Japan

[21] Appl. No.: 853,671

[22] Filed: May 9, 1997

[30] Foreign Application Priority Data

May 14, 1996 [JP] Japan ..... 8-118738

[51] Int. Cl.[6] ..... F02M 35/10

[52] U.S. Cl. ..... 123/184.53; 123/593

[58] Field of Search ..... 123/184.53, 184.56, 123/184.42, 184.34, 593

[56] References Cited

U.S. PATENT DOCUMENTS

| | | | |
|---|---|---|---|
| 3,934,569 | 1/1976 | Bobene | 123/593 |
| 4,295,458 | 10/1981 | Pellerin | 123/593 |
| 4,643,136 | 2/1987 | Ura et al. | 123/184.42 |
| 4,667,648 | 5/1987 | Beldin | 123/593 |
| 4,986,225 | 1/1991 | Wu et al. | 123/184.53 |
| 5,323,753 | 6/1994 | Cikanek, Jr. et al. | 123/593 |
| 5,388,559 | 2/1995 | O'Keefe | 123/593 |
| 5,623,900 | 4/1997 | Topfer et al. | 123/184.42 |

FOREIGN PATENT DOCUMENTS

| | | | |
|---|---|---|---|
| 1008178 A | 5/1952 | France . | |
| 466 655 C | 9/1928 | Germany . | |
| 26 41 066 A | 3/1978 | Germany . | |
| 57-107838 | 12/1955 | Japan . | |
| 2-052489 | 4/1990 | Japan . | |
| 284 184 A | 9/1952 | Switzerland . | |
| 2202276 | 9/1988 | United Kingdom | 123/184.56 |

*Primary Examiner*—David A. Okonsky
*Attorney, Agent, or Firm*—Cushman Darby & Cushman IP Group of Pillsbury Madison & Sutro LLP

[57] ABSTRACT

An intake passage structure for an internal combustion engine has a first passage portion where a throttle valve is disposed and a second passage portion, downstream of the fist passage portion, where a mesh member is disposed. A relationship $S_1 \leqq \alpha S_2$ holds between a cross-sectional area $S_1$ of the first passage portion and a cross-sectional area $S_2$ of the second passage portion where $\alpha$ is an open area rate of the mesh member. A clearance may be provided between a periphery of the mesh member and an inside surface of the intake pipe where the mesh member is disposed.

6 Claims, 2 Drawing Sheets

INTAKE PASSAGE STRUCTURE FOR AN INTERNAL COMBUSTION ENGINE

This application is based on application No. HEI 8-118738 filed in Japan on May 14, 1996, the content of which is incorporated hereinto by reference.

BACKGROUND OF THE INVENTION

1. Field of the Invention

The present invention relates to an intake passage structure for an internal combustion engine, and more particularly to an intake passage structure for an internal combustion engine with a mesh member in an intake passage that prevents an increase in intake air flow resistance.

2. Description of Related Art

Japanese Utility Model Publication SHO 57-107838 discloses an intake passage structure for an internal combustion engine wherein a mesh is provided downstream of a throttle valve in an intake air passage. The mesh is provided for protecting the throttle valve from back fire from a cylinder of the internal combustion engine.

However, the mesh increases intake air flow resistance which decreases the air intake efficiency.

Further, moisture from the intake air, including moisture contained in the atmosphere itself and moisture due to PCV (positive crankcase ventilation), can become trapped by the mesh and ice up in throttle body causing problems with the throttle valve opening and/or closing.

SUMMARY OF THE INVENTION

An object of the present invention is to provide an intake passage structure for internal combustion engines capable of suppressing an increase in the intake air flow resistance due to a mesh member.

In an intake passage structure for an internal combustion engine according to the present invention, which has a mesh member disposed downstream of a throttle valve, the relationship $$S_1 \leqq \alpha S_2$$

is provided between a cross-sectional area of a first passage portion $S_1$ where the throttle valve is disposed and a cross-sectional area of a second passage portion $S_2$ where the mesh member is disposed where $\alpha$ is a ratio of an open area to an entire area (summation of the open area and a closed area) of the mesh member (hereinafter referred to as an open area rate).

A clearance for permitting a portion of intake air to pass therethrough may be provided between a periphery of the mesh member and an inside surface of an intake pipe in which the mesh member is disposed.

Due to the above-described structural relationship, the intake passage is not throttled in cross-sectional area by the mesh member. As a result, the intake air flow resistance does not increase despite provision of the mesh member, so that the air intake efficiency does not decrease.

Further, in the case where a clearance is provided between the mesh member and the inside surface of the intake pipe, since intake air can flow through both the mesh member and the clearance, the intake air flow resistance does not increase despite provision of the mesh member, so that the air intake efficiency does not decrease.

BRIEF DESCRIPTION OF THE DRAWINGS

The above and other objects, features, and advantages of the present invention will become more apparent and will be more readily appreciated from the following detailed description of the preferred embodiments of the present invention in conjunction with the accompanying drawings, in which.

DETAILED DESCRIPTION OF THE PREFERRED EMBODIMENTS

Figure 1:
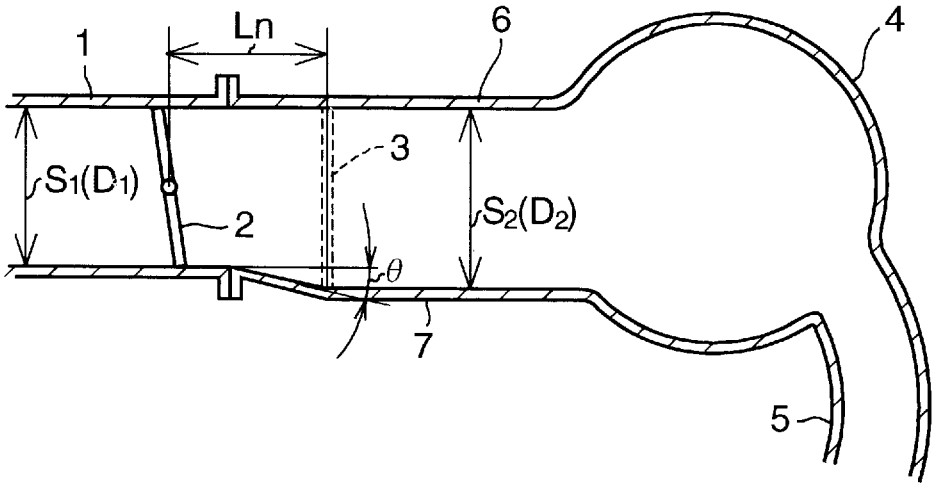
FIG. 1 is a cross-sectional view of an intake passage structure for an internal combustion engine according to a first embodiment of the present invention, wherein an air connector is provided.
Figure 2:
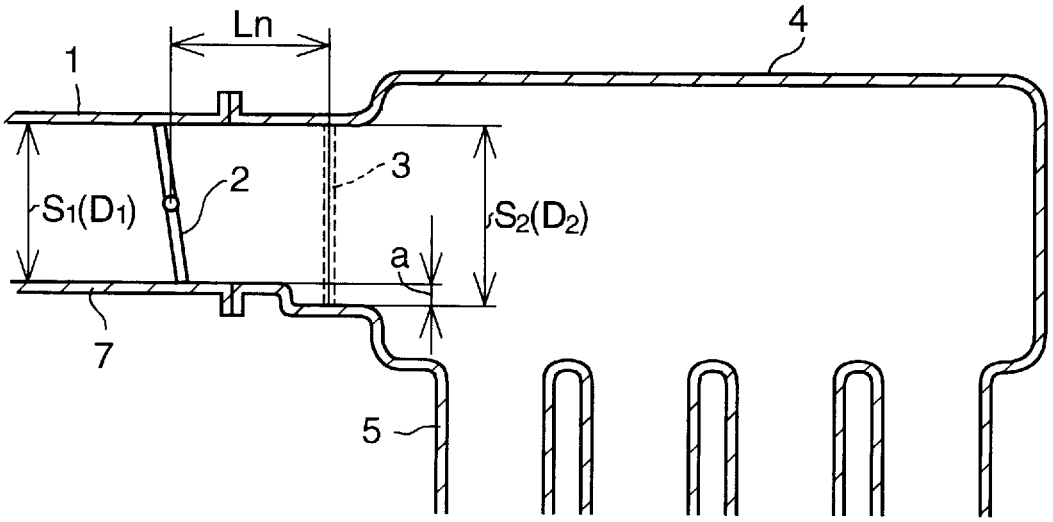
FIG. 2 is a cross-sectional view of an intake passage structure for an internal combustion engine according to a second embodiment of the present invention, wherein an air connector is not provided.
Figure 3:
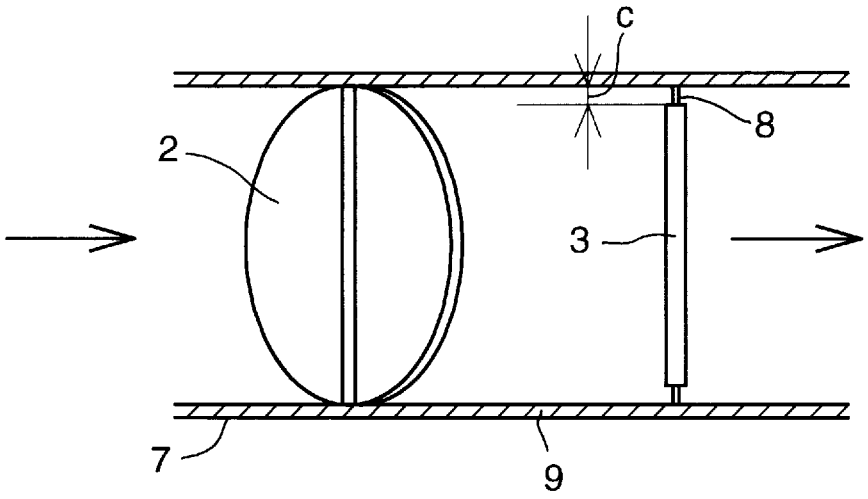
FIG. 3 is a cross-sectional view of an intake passage structure for an internal combustion engine according to a third embodiment of the present invention.

FIGS. 1, 2 and 3 illustrate intake passage structures for an internal combustion engine according to first, second and third embodiments of the present invention. Portions common or similar to each other throughout all of the embodiments of the present invention are denoted with the same reference numerals throughout all of the embodiments of the present invention.

First, portions common or similar to each other throughout all of the embodiments of the present invention will be explained with reference to, for example, FIG. 1.

As illustrated in FIG. 1, an intake passage structure includes an intake air passage 7. The intake air passage 7 includes a throttle body 1, a surge tank 4 disposed downstream of the throttle body 1 in an intake air flow direction, and an air connector 6 disposed between the throttle body 1 and the surge tank 4. The air connector 6 is not indispensable. The intake air passage 7 includes a first passage portion which is a throttle body 1 and a second passage portion which is located downstream of the first passage portion and upstream of the surge tank 4. A throttle valve 2 is disposed in the throttle body 1 or the first passage portion so that the throttle valve 2 can be open and closed. A mesh member 3 is disposed in the second passage portion located downstream of the throttle valve 2. The mesh member 3 is made from, for example, a metal net or a punched metal plate. The mesh member 3 operates to protect the throttle valve 2 from damage from a cylinder of the engine backfiring. The mesh member 3 further operates so as to make the intake flow uniform and to suppress intake air flow sound generated when the throttle valve 2 is opened at a high speed.

Next, portions unique to each embodiment of the present invention will be explained.

With a first embodiment of the present invention, as illustrated in FIG. 1, an air connector 6 is provided. The following relationship holds between the first passage portion and the second passage portion:

$$S_1 \leqq \alpha S_2,$$

or $$(D_1)^2 \leqq \alpha (D_2)^2$$

where:

$S_1$ is a cross-sectional area of the first passage portion, $S_2$ is a cross-sectional area of the second passage portion, $D_1$ is a diameter of the first passage portion, $D_2$ is a diameter of the second passage portion, and $\alpha$ is an open area rate (a ratio of an open area to an entire area of the mesh member).

In the case where the above-described relationship holds, a pipe diameter of the second passage portion is greater than a pipe diameter of the first passage portion. In this instance, the second passage portion is downwardly dislocated from the fist passage portion, so that a bottom surface of the second passage portion is positioned at a lower level than a bottom surface of the first passage portion, while an upper surface of the second passage portion is positioned as the same level as an upper surface of the first passage portion. The bottom surface of the second passage portion is connected to the bottom surface of the first passage portion via an inclined surface inclined from the horizontal so as to ascend toward the first passage portion. An angle of the inclination, $\theta$, is illustrated in FIG. 1. This structure prevents water trapped by the mesh member 3 from flowing reversely toward the throttle valve 2.

Preferably, from the viewpoint of suppressing noise, the mesh member 3 is located at a position spaced away from the throttle valve 2 by a distance in the range of $0.5D_1$–$2D_1$.

With a second embodiment of the present invention, as illustrated in FIG. 2, an air connector 6 is not provided, wherein the throttle body 1 is connected directly to the surge tank 4. Further, the second passage portion is downwardly dislocated from the fist passage portion, so that a bottom surface of the second passage portion is positioned at a lower level than a bottom surface of the first passage portion, while an upper surface of the second passage portion is positioned as the same level as an upper surface of the first passage portion. The bottom surface of the second passage portion is connected to the bottom surface of the first passage portion via a step having a height a. Other structures are the same as those of the first embodiment of the present invention.

Figure 4:
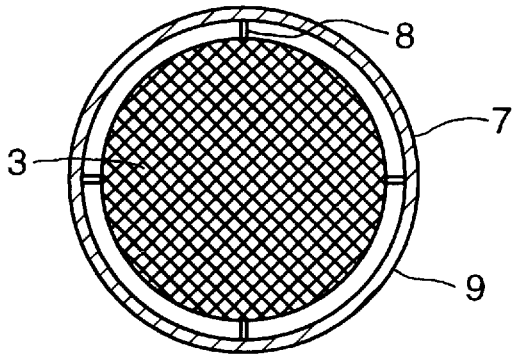
FIG. 4 is a front elevational view of the structure of FIG. 3.

With a third embodiment of the present invention, as illustrated in FIGS. 3 and 4, a clearance c for permitting a portion of intake air to pass therethrough is provided between the mesh member 3 and an inside surface of an intake pipe 9 (which is a portion of the intake air passage 7 and in which the mesh member 3 is disposed). More particularly, the mesh member 3 is manufactured so as to have a smaller diameter than the inside surface of the intake pipe 9. Then, the mesh member 3 is disposed within the intake pipe 9 and is supported by support members 8 so that the mesh member 3 is located at a central portion of the intake pipe with the clearance c between the periphery of the mesh member 3 and the inside surface of the intake pipe 9 along an entire circumference of the mesh member 3. The size of the clearance c is selected so as to satisfy both the noise suppressing effect and icing prevention effect.

The structure of the clearance c may be provided in addition to the structure of any of the first embodiment and the second embodiment, or the structure of the clearance c only may be provided independently of any of the first embodiment and the second embodiment.

Next, the operation of a device according to the present invention will be explained.

With the first and second embodiments of the present invention, the mesh member 3 makes the intake air flow uniform and prevents noise from occurring even when the throttle valve 2 is opened at a high speed.

Further, since the relationship of $S_1 \leqq \alpha S_2$ or $(D_1)^2 \leqq \alpha(D_2)^2$ holds, the cross-sectional area of the second passage portion of the intake air passage is not throttled compared with the first passage portion despite provision of the mesh member 3, the air flow resistance is prevented from increasing at the mesh member 3, so that high efficiency air intake is maintained.

Furthermore, since the bottom surface of the second passage portion is at a lower level than the bottom surface of the first passage portion, water trapped by the mesh member 3 does not flow to the throttle valve 2 and does not cause sticking of the throttle valve 2 to the wall of the passage due to icing of the trapped water at the throttle valve 2.

With the third embodiment of the present invention, due to clearance c between the mesh member 3 and the inside surface of the intake pipe 9, a portion of intake gas flows through not only the mesh member 3 but also the clearance, the air flow resistance does not increase despite provision of the mesh member 3 and high efficiency air intake is maintained. Further, even if moisture becomes trapped by the mesh member 3 to produce collected water on the bottom surface of the intake pipe 9, the water will be blown in a downstream direction, so that the water will not reach the throttle valve 2. As a result, sticking of the throttle valve 2 to the intake pipe 9 due to icing of the water does not occur.

According to the present invention, the following technical advantages are obtained:

First, since the relationship of $S_1 \leqq \alpha S_2$ or $(D_1)^2\ \alpha\ (D_2)^2$ holds, the air flow resistance does not increase so that high efficiency air intake is maintained.

Second, in the case where the clearance c is provided between the mesh member and the inside surface of the intake pipe, a portion of the intake air can flow through the clearance. As a result, the air flow resistance does not increase so that high efficiency air intake is maintained.

Although the present invention has been described with reference to specific exemplary embodiments, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. An intake passage structure for an internal combustion engine comprising:

an intake air passage including a first passage portion and a second passage portion located downstream of said first passage portion, said first passage portion having a first cross-sectional area $S_1$, said second passage portion having a second cross-sectional area $S_2$;

a throttle valve disposed in said first passage portion; and a mesh member disposed in said second passage portion, said mesh member having an open area rate $\alpha$, wherein said first cross-sectional area $S_1$, said second cross-sectional area $S_2$ and said open area rate $\alpha$ satisfy the following relationship:

$$S_1 \leqq \alpha S_2$$

2. An intake passage structure according to claim 1, wherein said first passage portion has a first diameter $D_1$, and said second passage portion has a second diameter $D_2$, said first diameter $D_1$, said second diameter $D_2$ and said open area rate $\alpha$ having the following relationship:

$$(D_1)^2 \leqq \alpha(D_2)^2$$

3. An intake passage structure according to claim 1, wherein said second passage portion has a bottom surface and said first passage portion has a bottom surface, said bottom surface of said second passage portion being positioned at a lower level than said bottom surface of said first passage portion.

4. An intake passage structure according to claim 3, wherein said bottom surface of said second passage portion is connected to said bottom surface of said first passage portion via an inclined surface.

5. An intake passage structure according to claim 3, wherein said bottom surface of said second passage portion is connected to said bottom surface of said first passage portion via a stepped surface.

6. An intake passage structure according to claim 1, wherein said mesh member is disposed at a position spaced away from said throttle valve by a distance Ln in the range of $0.5D_1$–$2D_1$.

* * * * *